United States Patent [19]

Ottestad

[11] Patent Number: 5,065,824

[45] Date of Patent: Nov. 19, 1991

[54] HYDRAULICALLY POWERED REPETITIVE IMPACT HAMMER

[75] Inventor: Jack B. Ottestad, La Jolla, Calif.

[73] Assignee: Esco Corporation, Portland, Oreg.

[21] Appl. No.: 457,479

[22] Filed: Dec. 28, 1989

[51] Int. Cl.[5] ..... B25D 9/18; F01L 15/12

[52] U.S. Cl. ..... 173/134; 91/173; 91/224; 91/229

[58] Field of Search ..... 173/90, 114, 116, 134, 173/136, 17; 91/222, 224, 229, 173

[56] References Cited

U.S. PATENT DOCUMENTS

| | | | |
|---|---|---|---|
| 1,096,886 | 5/1914 | Bayles | 91/224 |
| 1,264,318 | 4/1918 | McGrath | 91/229 |
| 2,539,292 | 1/1951 | Anderson | 91/229 |
| 3,101,796 | 8/1963 | Stall et al. | 91/229 |
| 3,363,512 | 1/1968 | Ottestad | 91/173 |
| 3,363,513 | 1/1968 | Ottestad | 91/173 |
| 3,524,385 | 8/1970 | Ottestad | 91/224 |
| 4,111,269 | 9/1978 | Ottestad | 173/134 |

*Primary Examiner*—Mark Rosenbaum
*Assistant Examiner*—Scott A. Smith
*Attorney, Agent, or Firm*—Chernoff, Vilhauer, McClung & Stenzel

[57] ABSTRACT

An impact hammer according to this invention has a frame to house its actuating mechanism and to support a working impact tool which is to receive a sharp impact blow from the impact hammer and deliver it to a structure or formation that is to be pierced or fragmented. The impact tool projects from the frame and is axially reciprocable in the frame. A hammer head is reciprocably mounted in the frame with a close sliding fit. It has an impact face that faces toward the impact tool to strike the tool when the impact is intended to occur. At positions beyond this intended range, the hammer head is braked so it does not impact the frame. The blow to the tool is a high-energy, sharp blow, and is not intended to contribute a follow-on application of force after the initial impact. The hammer head has a shank, a loading shoulder and a poppet port. A poppet is reciprocably fitted in the hammer head with a poppet head so proportioned and arranged as to close the poppet port to enable the impact hammer to be loaded, and to be abruptly removed from the poppet port to enable the impact hammer to be fired. A firing pin is fitted in the frame to cooperate with the poppet to unseat the poppet when the impact hammer is to be fired.

5 Claims, 13 Drawing Sheets

HYDRAULICALLY POWERED REPETITIVE IMPACT HAMMER

FIELD OF THE INVENTION

This invention relates to impact hammers for delivering repetitive impact blows useful, for example, in mining, digging and demolition operations.

BACKGROUND OF THE INVENTION

Impact hammers are widely used in mining, digging, and demolition work. Their function is to apply high unit area impact loads repetitively to a surface to fragment it or to divide it. The common jackhammer is an example of a pneumatically-powered device driven by compressed air, which delivers sharp impact blows at the tip of a tool such as a pick or a spade.

While the jackhammer remains in widespread use, its application has gradually been reduced to relatively portable tools handled by a muscular individual. The reaction to these blows is exerted by the mass of the tool, and by the operator. This is an obvious limitation on the utility of this type of tool.

Accordingly, carriage-mounted pneumatic impact tools came into vogue, but it soon became apparent that while they could accommodate hammers which could deliver heavier blows, the hammers themselves became a limiting feature because of the inherent limitations of directly using a compressed gas for power. The volume of flow, the energy losses incurred in the compression-expansion cycle, and the inherent inefficiencies involved in the cycling of the gas through the hammer, among other complications, exerted an undesirable limit on the energy of the impacts that could be delivered, regardless of how suitably the hammer was mounted.

In response to these limitations, a liquid-powered class of impact hammers has developed during recent decades. Because the pressurized liquid used for powering the device is substantially non-compressible, many of the most troublesome problems of the pneumatic devices are avoided. The hoses, fittings and passages are sized to accommodate the liquid volume, and there are no significant losses caused by expansion, because there is no substantial expansion of the motive fluid itself.

The general theory of liquid-powered devices is to utilize a gas cell that is compressed by a pressurized liquid. The cell and the liquid which pressurizes it are held captive by a quickopening poppet valve. When the valve is opened, the pressurized liquid driven by the expanding gas cell is applied to a driven face of a hammer head. This is a very abrupt, high energy release situation. The driving pressure may be on the order of 2,000 psi or greater, and the effective area of the driven face may be on the order of at least 5 square inches to as much as 1,258 square inches.

In turn, the hammer head strikes a tool whose point or blade is usually at least several times smaller at the point of impact. The advantages of such an arrangement are obvious, and are reflected in the following exemplary United States patents:

| U.S. Pat. No. | Issue Date |
|---|---|
| 3,263,575 | August 2, 1966 |
| 3,363,512 | January 16, 1968 |
| 3,363,513 | January 16, 1968 |
| 4,111,269 | September 5, 1978 |

Impact hammers of this general class are widely used, and in fact deliver blows of much greater impulse than pneumatically powered tools, even carriage mounted pneumatically powered tools.

In the continuing course of development of liquid powered impact hammers, problems have continually arisen which are not encountered in gas powered tools. The literature contains mention of many of them. Cavitation is one, liquid hammer effects are another. Most of these have been solved by one means or another, but there still remain the stubborn problems of reducing the flow of pressurized liquid to a sensible minimum, and of appropriately valving the flow of the liquid such that the fluid does not impede the loading or discharge of the tool, and so the tool does not destroy itself or have a degraded performance as the consequence of abrupt blows between the elements of the tool itself.

These problems have not yet previously been fully corrected. It is an object of this invention to provide in an impact hammer a flow and valving system for loading and discharging an impact tool which, while forgiving of external forces and effects still enables the tool reliably to be operated in a wide array of operating conditions on a near-minimum volume of liquid, with only minimal, if any, impediment to the loading and discharge of the tool, and without damaging internal blows between the elements of the impact hammer itself. It is intended that any sharp blow be only between the head of the hammer and the impact tool, and that this be exerted only over a very short stroke length.

As a further advantage, the above objectives are attained in an impact hammer which has a minimal number of parts, all of which are constructed with inherently stable shapes and substantial sections so as to resist the very strong and abrupt forces which are involved in the operation of this device.

BRIEF DESCRIPTION OF THE INVENTION

An impact hammer according to this invention has a frame to house its actuating mechanism and to support a working impact tool which is to receive a sharp impact blow from the impact hammer and deliver it to a structure or formation that is to be pierced or fragmented. The impact tool projects from the frame, and is axially reciprocable in the frame.

A hammer head is reciprocably mounted in the frame with a close sliding fit. It has an impact face that faces toward the impact tool to strike the tool when the impact end of the tool is within a range of positions where impact is intended to occur. At positions beyond this intended range, the hammer head is braked so it does not impact the frame. The blow to the tool is a high-energy, sharp blow, and is not intended to contribute a follow-on application of force after the initial impact.

The hammer head is opposed by a compressible gas cell. The gas cell is pre-loaded to a desired pressure, which will be increased as the consequence of further loading by movement of the hammer head under the force of a liquid applied to the hammer head while loading the impact hammer for its next stroke.

The hammer head has a shank, a loading shoulder and a poppet port. A poppet is reciprocably fitted in the hammer head with a poppet head so proportioned and arranged as to close the poppet port to enable the impact hammer to be loaded, and to be abruptly removed form the poppet port to enable the impact hammer to be fired. A firing pin is fitted in the frame to cooperate with the poppet to unseat the poppet when the impact hammer is to be fired.

The features of this invention relate to assuring that (1) the impact hammer can be loaded under all operational conditions. (2) that the poppet will not be subjected to abrupt internal impacts which will tend to destroy it, (3) that the impact hammer can readily be fired under all working conditions, and (4) that the hammer head will not overtravel so as to deliver a blow to the frame itself.

These and other features of this invention will be fully understood from the following detailed description and the accompanying drawings, in which:

BRIEF DESCRIPTION OF THE DRAWINGS

As shown in FIGS. 1-7, an impact hammer 20 according to this invention has a frame 21 with a central axis 22. The impact blow is delivered along this axis. The frame has a tool passage 23 with a schematically shown relief 24. An impact tool 25, such as a sharp-pointed pick is fitted in the tool passage. A retainer shoulder 26 fits in the relief, and this engagement holds the tool in the passage. It enables limited reciprocation between extreme positions defined by shoulders 27 and 28. Persons skilled in the art will recognize that there are various other types of retention means useful for this purpose.

Figure 1:
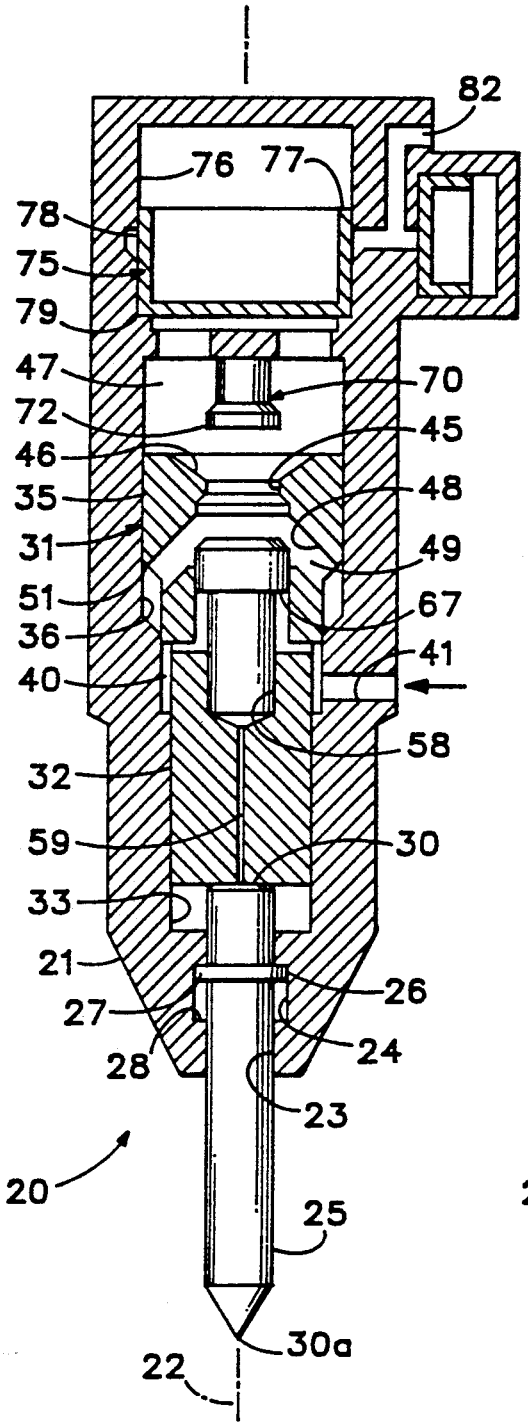
FIGS. 1-7 are axial cross-sections of an impact hammer according to the general concept of the invention, shown in seven successive stages of operation. For clarity of disclosure, some details of the invention have been omitted which are presented in other Figs. in enlarged scale.

The impact tool may be any other desired type, for example spades, or curved or cylindrical cutters. The impact tool has an impact end 30 to receive an impact, and a working end 30a to deliver a resulting blow to a working face which is to be broken or fragmented.

The impact hammer includes a hammer head 31 with a shank 32 fitted in a guide cylinder 33 in the frame. The bottom end of the hammer head is vented to atmosphere past the impact tool, through relief 24.

For manufacturing purposes, the inside surfaces of the frame and the inside and outside surfaces of the hammer head will preferably be circular. A loading collar 35 is formed on the hammer head. Its diameter is larger than the diameter of guide cylinder 33, and the collar is slidingly fitted in a loading cylinder 36. It will be seen that there is a differential between the area of the loading collar 35 at the upper end of the hammer head as viewed in FIG. 1, and the area of the head shank 32 at the lower end. The terms "upper" and "lower" as used throughout this specification refer to distances from the impact tool, the closer ones being the "lower" ones.

A loading chamber 40 is formed between guide cylinder 33 and loading cylinder 36. A pressure inlet port 41 passes through the wall of the frame into the loading chamber.

A poppet port 45 is formed at the top of the hammer head. Its upper face 46 faces into a compression chamber 47, and its lower face 48 faces into a poppet chamber 49 from which passage 50 branches to below the lower face 51 of loading collar 35. Passages 53 open into loading chamber 40 from the lower end of a poppet head chamber 52.

A poppet 55 includes a poppet stem 56 and a poppet head 57. The stem is reciprocable in poppet passage 58 in the hammer head shank. A relief passage 59 extends from the bottom of the poppet passage to the impact end of the hammer shank, so as to vent the poppet passage to atmosphere. The poppet head reciprocates in poppet head chamber 52. Appropriate seal means, or close enough tolerances, are provided to prevent substantial leakage of fluid into the poppet passage. The poppet head has a shoulder 60, a poppet drive face 67 on said shoulder, a closure face 65 facing toward lower face 48 of the poppet port, and a cylindrical wall 66 slidably fitted in poppet head chamber 52.

A firing pin 70 is supported by the frame in the path of the poppet in compression chamber 47 by a spider 71. The firing pin has a cylindrical outer wall 72 adapted to enter into the poppet port, and a face 73, both for a purpose to be described.

A gas cell 75 is mounted in the frame at its upper end. It includes an internal cylindrical wall 76. A cup-like piston 77 is slidingly fitted in wall 76. It has a peripheral cylindrical wall 78 with an outer metering edge 79. A charge of gas under suitable pressure, often about 500 psi is loaded into this cell. This expands the cell as shown in FIG. 1. The piston is stopped at one extreme of its movement by a limit shoulder 80

At drain port 81 opens into wall 76. Port 81 is closed by peripheral wall 78 of the piston in some positions of the piston and remains open in others. Drain line 82 extends through the frame to a reservoir (not shown). A secondary gas cell 83 can optionally be placed in the drain line to assure adequate drainage if needed.

The general operation of this device will now be described, with reference to FIGS. 1-7, which show seven successive stages of its operation.

In FIG. 1, the hammer head is shown in its condition just after it has delivered a blow to the impact tool, and is about to begin to reload. Notice that impact tool 25 has been forced to its upper limit by weight of the impact hammer exerted on its impact end resisted by material it is to fragment at its working end. Retainer shoulder 26 is restrained by shoulder 27 in relief 24 so impact end 30 is disposed at the location where it is intended for the next blow to be delivered.

At this time gas cell 75 is fully expanded. Wall 76 closes the drain port.

The poppet is in its lowermost position, as is the hammer head. The poppet port is open. Inlet port 41 (which is always open to pressure) is in communication with poppet head chamber 52, ready to exert hydraulic pressure on poppet drive face 67. Compression chamber 47 and poppet chamber 49 are at the same pressure. Notice that further expansion of the gas cell is prevented by limit shoulder 80.

Figure 2:
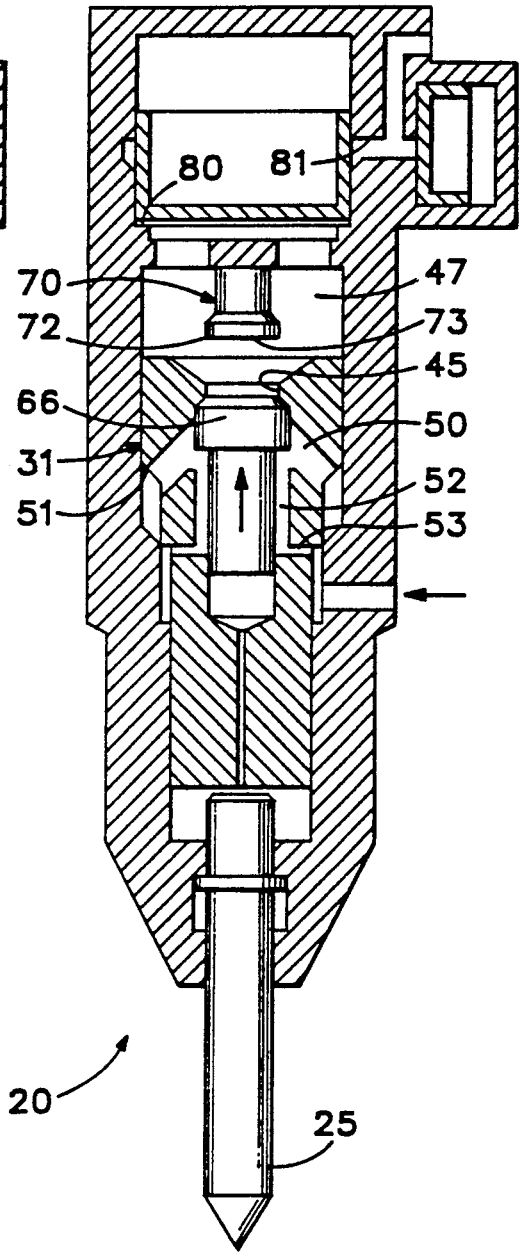
Figure 3:
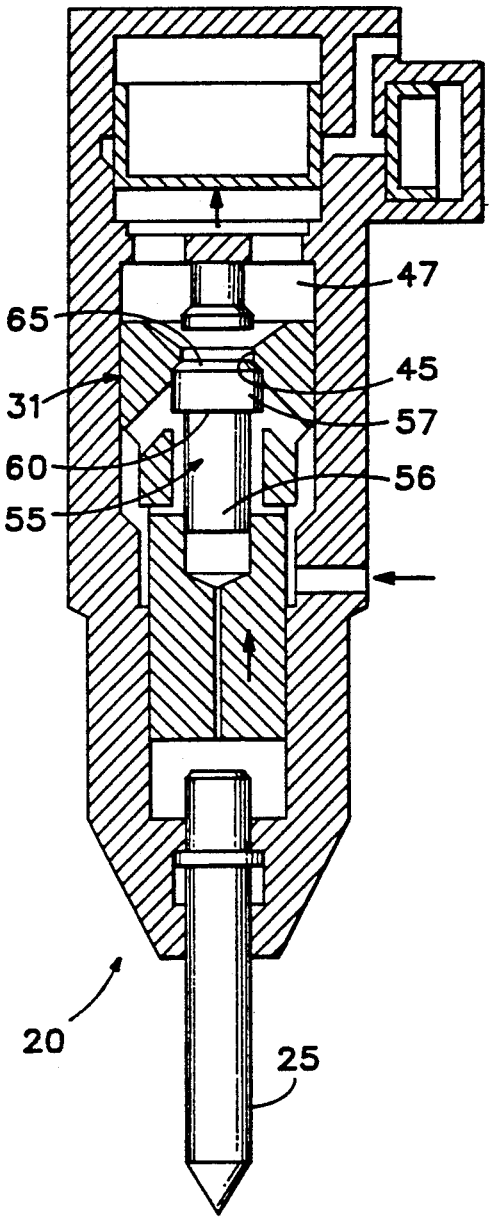

Exertion of sufficient hydraulic pressure on poppet drive face 67 will start the next stage, which is shown in FIG. 2. This pressure will drive the poppet upwardly to close poppet port 45. This also opens poppet head chamber 52 to passages 50, and this provides hydraulic pressure to loading cylinder 36 from the inlet port. This enables the resulting differential force across the hammer head to start moving the hammer head upwardly, as shown in FIG. 3.

In FIG. 3, notice again that the annular poppet head chamber 52 has been opened to loading collar 35. The hammer head will now continue to move upwardly. Compression chamber 47 is filled with hydraulic fluid, which is held between the gas cell and the upper face of the hammer head. The liquid is substantially incompressible, but the gas in the cell is compressible. Therefore the pressure created in compression chamber 47 is transmitted to the gas cell, which compresses and stores energy. All this time the drain is closed by the wall of piston 77. The upper end of the hammer head is approaching the firing pin.

Figure 4:
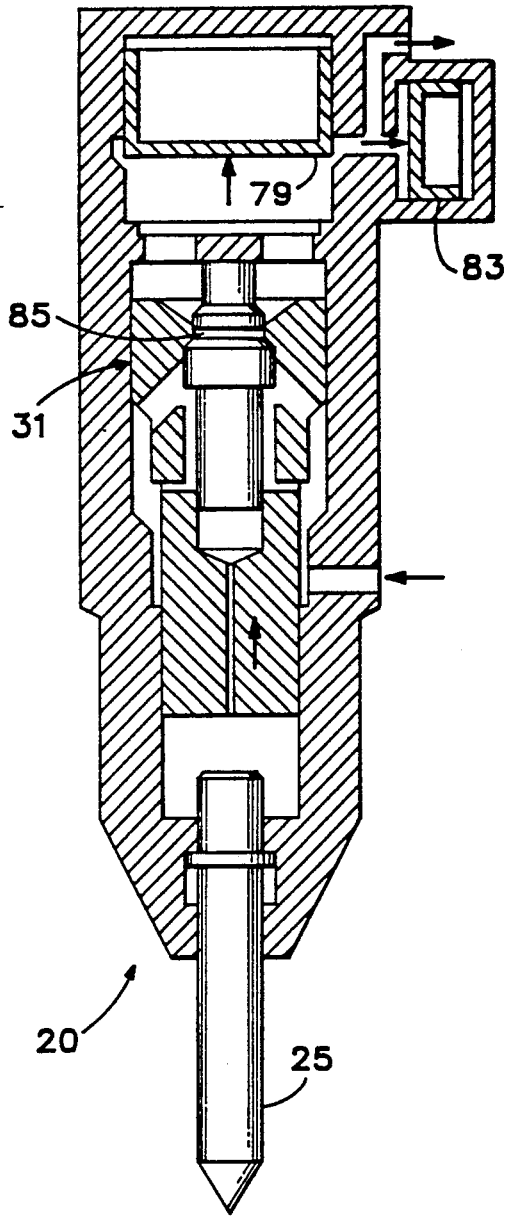

FIG. 4 shows the situation where the impact hammer is almost loaded and ready to fire. Attention is called to the fact that metering edge 79 of piston 77 in the gas cell has passed the lower edge of the drain port. If there were not some relief at this point it could occur that the system would lack the capacity to move the hammer head far enough to reach the firing pin. This is because the impact hammer still contains the fluid used in the previous cycle. At least that amount must be discharged. The relief provided by the metering edge opens the discharge port to permit exit of fluid in volume about equal to that used in the previous cycle.

The firing pin has now entered and closed the poppet port, trapping a volume 85 of hydraulic fluid between it and the head of the poppet.

Figure 5:
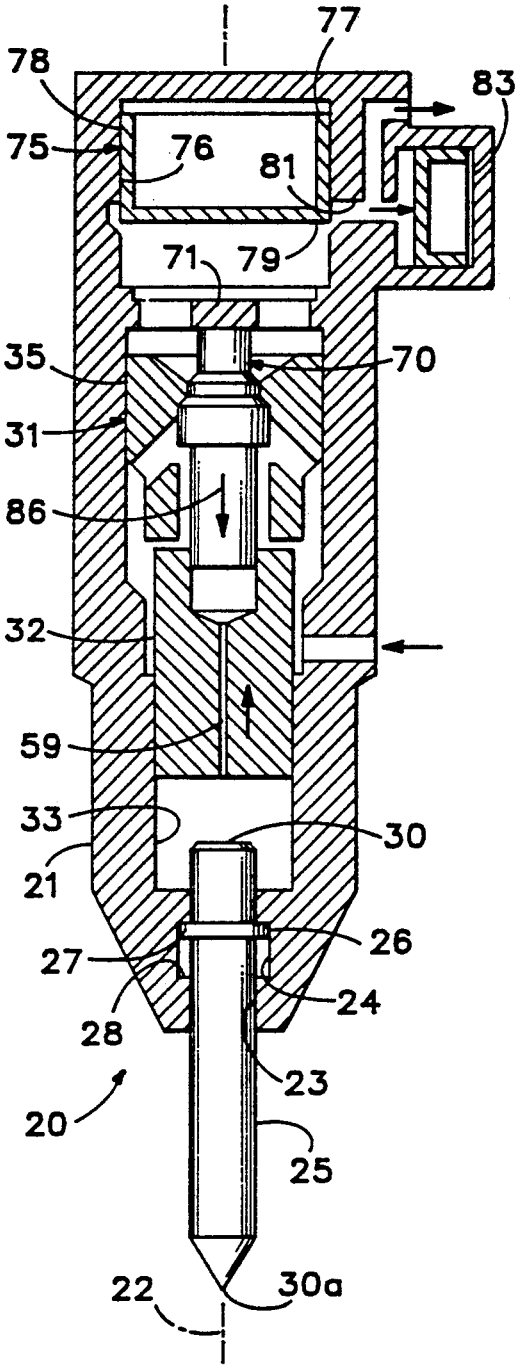

Upward movement of the hammer head continues for a short distance, until the stage shown in FIG. 5 occurs. At this moment, as later will be discussed in detail, the poppet head is unseated. An abrupt movement exemplified by arrow 86 occurs, driving the poppet open, very quickly. Now the hammer head will be driven axially by pressure exerted by the gas cell. This is the stage shown in FIG. 6.

Figure 6:
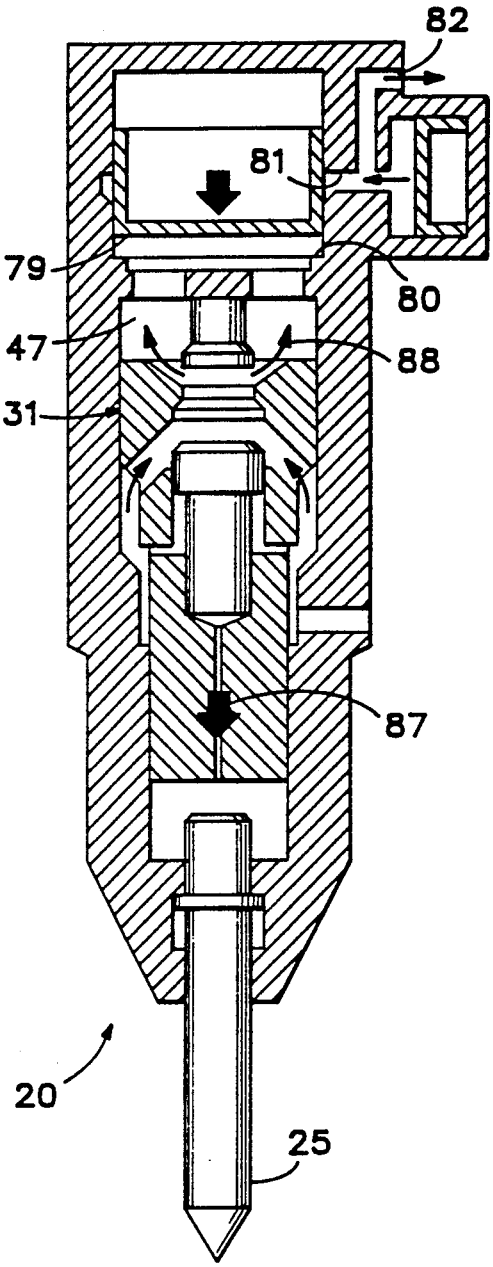

As shown in FIG. 6, the hammer head is on its way down, exemplified by arrow 87. This is enabled by freedom of hydraulic fluid to flow past the hammer head into the enlarging compression chamber 47, exemplified by arrows 88. The hammer head is swiftly driven toward the impact tool. Of course the firing pin is left behind in its fixed position.

Figure 7:
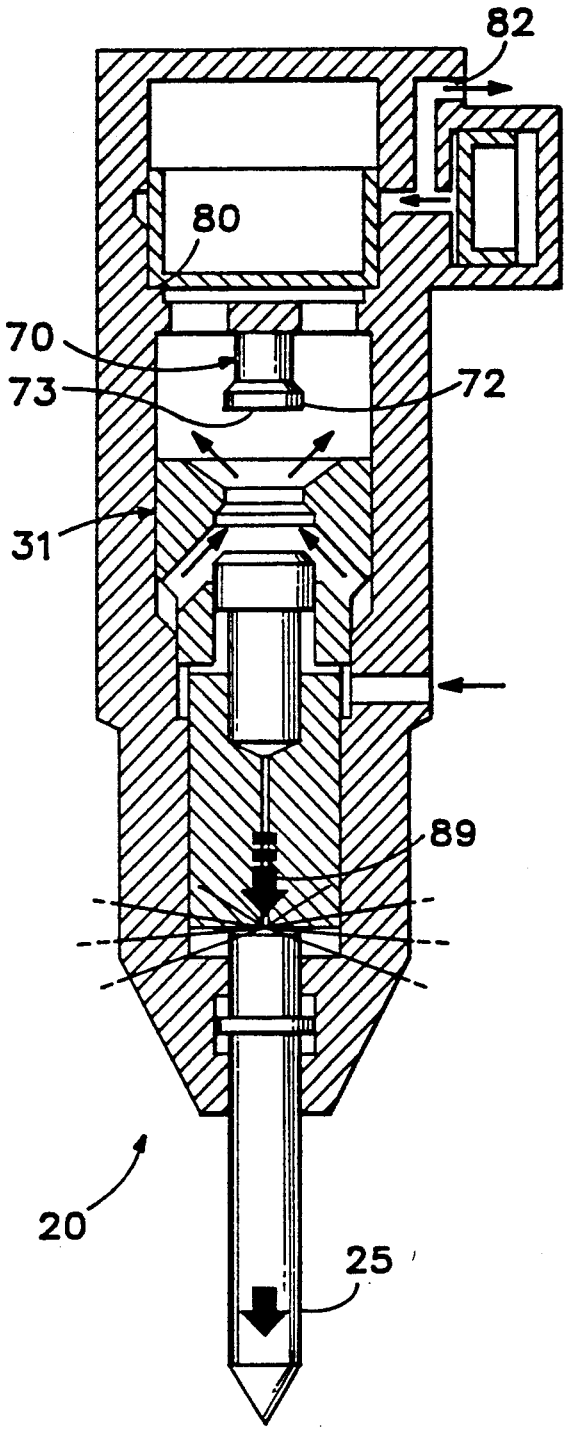

Impact conditions are shown in the stage illustrated in FIG. 7. The poppet has been driven to its lower limit. Recall that its lower end is vented to atmosphere. The hammer head has struck the impact end of the impact tool and the impact tool is transmitting that impulse, exemplified by arrow 89 to a working face 90. It is now necessary for the hammer head to stop even if for some reason, the impact tool had not been in place to be struck as shown in the previous FIGS. The braking function will be discussed in more detail later.

After the impact, the system can return to the stage shown in FIG. 1. At this point it may be desirable for emission of the ejected fluid from the drain port to be assisted. The secondary gas cell will assist with this, in case a long sluggish line or some other retarding feature might slow the necessary emission.

This system in theory is excellent. However, the impact hammer must be manufactured from conventional materials, using economical and conventional manufacturing techniques to commercial tolerances. Such hammers must be expected to operate successfully in many climates ranging from very hot to very cold. Also, it is desirable to be able readily to adapt the hammer to the use of various hydraulic fluids which differ greatly in viscosity. Water, oil, and water-oil suspensions or emulsions are examples.

Of even greater importance are the features of reliability of operation and reasonable length of time between repairs and services. An impact hammer made in strict accordance with the simplistic constructions shown in FIGS. 1-7 has not provided such advantages. Instead, while they may have worked for a limited number of cycles, still within too short a time or under various common operating conditions the hammer would not reliably fire, or would not fire at all. Often it would destroy parts of itself internally because of impact stresses exerted between its own parts.

The instant inventor has over a considerable period of time, and as the consequence of experiments and failures, determined that there are four problem areas, and by means of this invention he has solved them to produce a reliable, useful and long-lived impact hammer.

The problem areas are these:

1. Assurance is needed that the impact hammer can be loaded—that the poppet can be forced closed and kept closed in order to complete the loading process. Otherwise the impact hammer will stall.

2. Assurance that the impact hammer, once loaded, can be fired by the exertion of the supply pressure. Otherwise the firing of the impact hammer requires forces that are not practically available.

3. Protection of the hammer head and the frame against damage by impact with one another should the hammer head be placed in a circumstance where it could overtravel and strike the frame.

4. Protection of the poppet head against impact damage when being cycled toward its closed position should the hammer head be placed in a circumstance where it could overtravel.

In the course of its development, the iteration of FIGS. 1-7, although theoretically correct, proved to involve every one of the above problems. The problems themselves are far from obvious. To the contrary, each failure had to be analyzed. As it transpired, the causes of the failures were anything but evident, and even when learned, it frequently occurred that the "fix" for one problem caused yet another problem. Still it appears that the actual causes of the failures are now known, and have been incorporated into an impact hammer which thereby became fully reliable. While the details which make this concept economically viable appear in themselves to be relatively small, especially in such a large device, they were not easily invented, nor was the need for them easily found.

FIGS. 8-15 show the improvements made to enable the impact hammer system schematically shown in FIGS. 1-7 to operate reliably and with a suitable longevity. To the maximum extent possible, identical numbers have been given to functionally similar elements, and the description of these elements will not be repeated.

The principal differences will be found in the construction of the poppet head 157, in the lower face of the poppet port 145, in a power chamber 160, and in a restriction 161 between the power cylinder and loading chamber 40. Certain important dimensional relationships will also be disclosed.

With reference to FIGS. 8-15, pressure inlet port 41 enters loading chamber 40. In this embodiment, chamber 40 is formed by slightly enlarging the diameter of guide cylinder 33 above inlet port 41, and similarly enlarging the diameter of the head shank above the inlet port, as related to the position of the hammer head in the frame when in a lower position ready to be loaded. This creates a restriction 161 between loading chamber 40 and power chamber 160. This restriction is a sliding fluid sealing fit which exists over a range of hammer head positions at and below that shown in FIGS. 8-10, but which ceases to exist when the hammer head moves above this position. Thereafter, chambers 40 and 160 are directly connected.

Poppet head 157 is considerably modified from the construction shown in FIGS. 1-7. It has a lower shoulder 162 always exposed to pressure from inlet port 41 through loading chamber 40 and branches 53. The poppet passage has a relief step 165 in communication with branches 53 to assure of this communication. An annular cushioning shoulder 164 cooperates with a cushioning step 167 formed at the top of chamber 52, with a bottom seat 168 and a peripheral cylindrical wall 169. When the poppet is raised with its head above the cushioning step, branches 53 communicate directly with poppet chamber 49 through poppet head chamber 52. In the lowermost position of the poppet shown in FIG. 8, this communication will be blocked by a part of the poppet yet to be described.

Reverting now to the power chamber 160, it is formed between lower face 51 of loading collar 35, and a tapered shoulder 170 formed at the junction of the loading chamber 40 and the power chamber. The volume of this chamber varies as a function of the axial location of the hammer head in the frame. In positions at and below that which is shown in FIG. 8, its reduction in volume is useful in braking the hammer head against overtravel.

Figure 8:
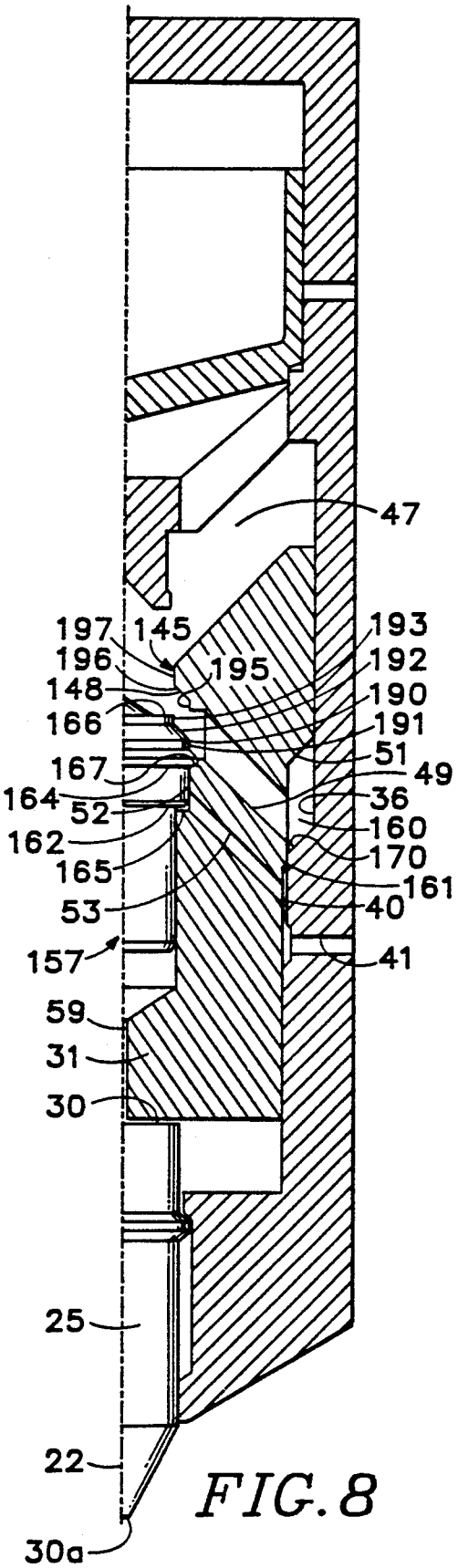
FIGS. 8-15 are half axial cross-sections showing the impact hammer in successive stages of operation and showing the preferred embodiment of the invention, in enlarged scale, including some of the omitted details.
Figure 9:
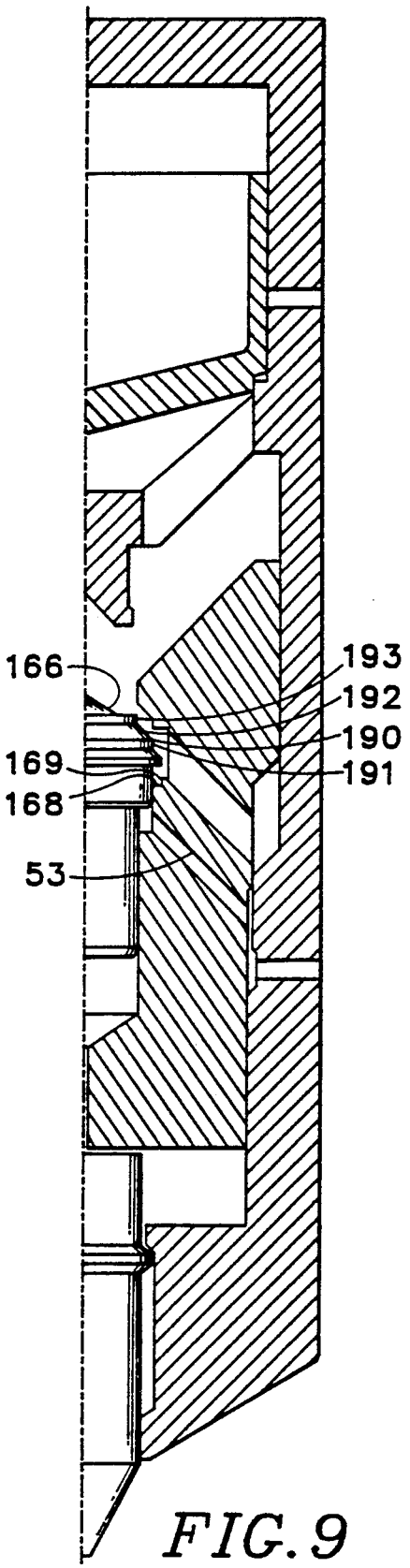
Figure 10:
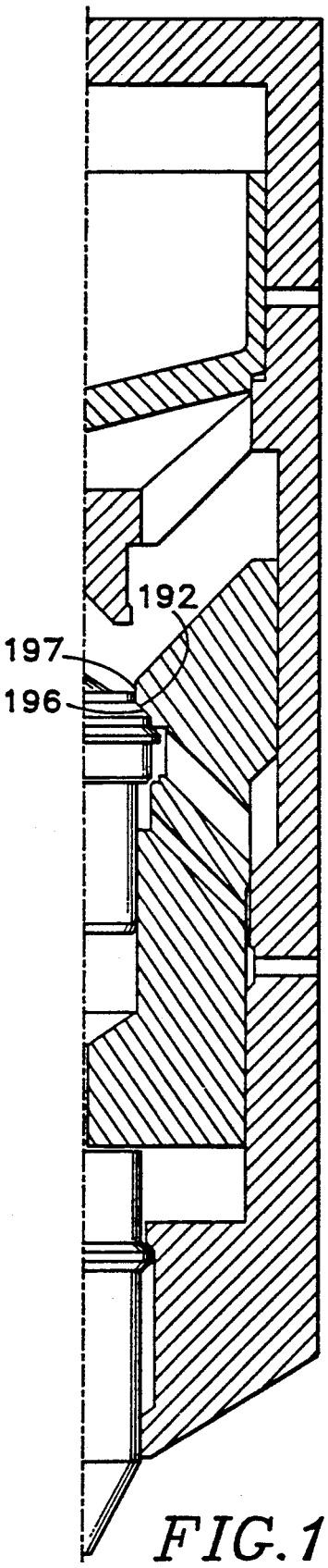
Figure 11:
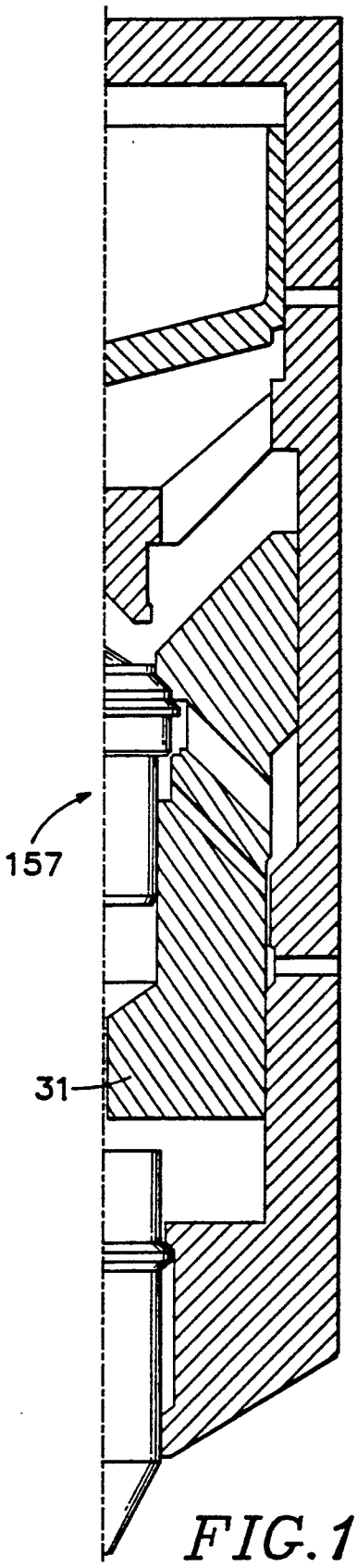
Figure 12:
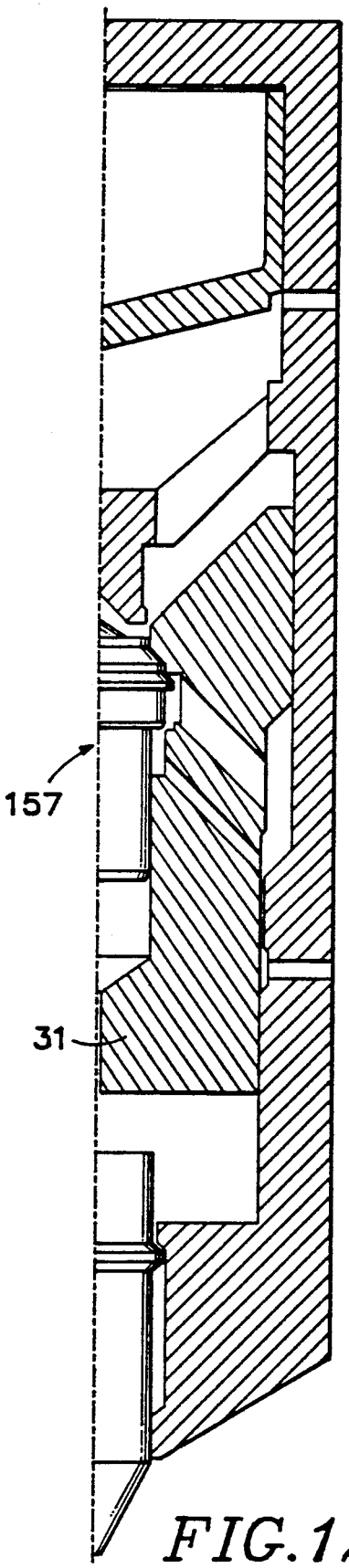
Figure 13:
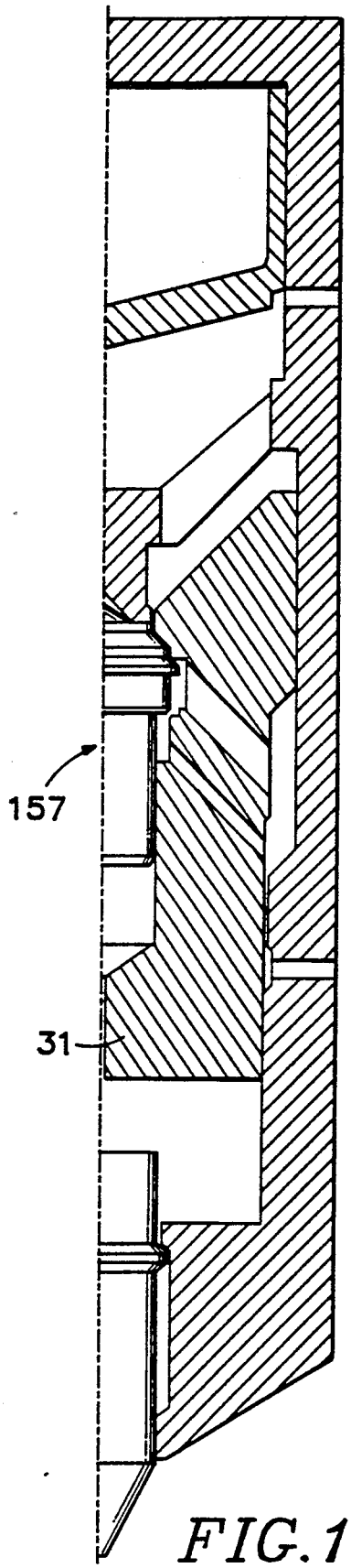
Figure 14:
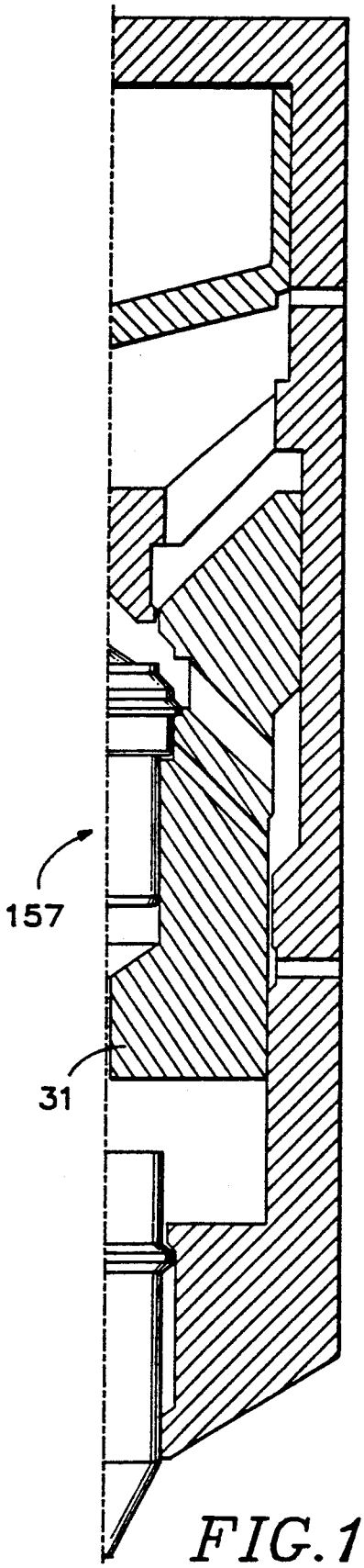
Figure 15:
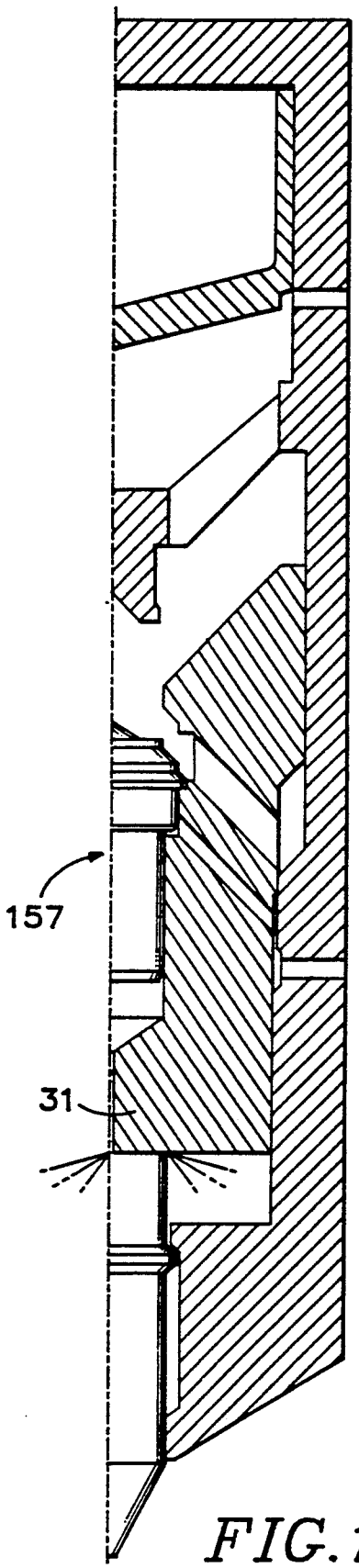

In hammer head positions above that shown in FIG. 8, it will be directly connected to loading chamber 40 so as to facilitate loading of the impact hammer.

At this point, a comment about overtravel of the impact hammer may be helpful. It is very undesirable for any part of the hammer head to strike the frame. Impact hammers of this type are designed to deliver hundreds of foot-pounds of energy in very short periods of time. The objective is to deliver a sharp blow with a high impulse, because high impulse blows are most effective for breaking or fragmenting structures. However, such blows delivered to the frame can be just as damaging to the frame itself as they are intended to be damaging to structures and formations to be fragmented.

As can be seen in FIGS. 8-15, the impact tool 25 is slidably fitted to the frame. When the impact hammer presses the tool against a structure it will be retracted as shown. Then, its impact end 30 is located as shown, and this is where the hammer head is best designed to strike it. When the hammer head does strike the impact end, it is intended for the energy of the hammer head to be transmitted to the impact tool, and this substantially brakes the hammer head against further movement toward the action end of the frame.

However, overtravel can result also from a "dry fire". This can occur for example when the hammer is operating in a horizontal alignment working along a vertical face and is firing automatically. Occasionally the impact tool may not be in contact with the face at all, or at least not firmly enough. These situations are sometimes called a "dry fire". Then the hammer head might not even reach the impact tool, or if it does, the impact tool may not transfer enough of the kinetic energy of the hammer head to stop the hammer head before it strikes the frame. To avoid internal damage the hammer head must be braked.

In whichever event, the braking action to stop this heavy element must usually be completed within about an inch or so of the travel. Such a quick braking action requires that further application of driving force be resisted. In turn this means using the pressure in loading chamber 40 and power chamber 160 to close the poppet valve to prevent fluid transfer to compression chamber 47, and to exert a resisting force tending to brake the hammer head.

In all circumstances, including blows under routine loading and alignment, as well as in dry firing or other overtravel-sensitive modes, the poppet itself is subject to rapid movement and to abrupt stops.

In fact, the axial movement of the poppet in both of its directions ends with a metal to metal contact. When the poppet port is opened to release the energy stored in the gas cell and compression chamber, it is important that it move quickly so as as not to impede the necessary fluid transfer through the poppet port to enable the impact hammer to move abruptly. However, such violent movement can soon destroy the poppet unless means is provided to cushion it at the extremes of its opening movement.

Also, while the closure of the poppet to enable the impact hammer to be loaded is done against pressure in the gas cell, and therefore is less abrupt, still the poppet is moved to closure by very substantial differential pressure. It is best practice to regulate this closure.

Of even greater importance is the potential damage to the poppet head when the hammer head is subject to overtraveling. Here the rate of closure of the poppet is particularly rapid, and the absence of suitable means to regulate the closure of the poppet under these conditions has led to considerable difficulty.

Still another circumstance can arise in the routine operation of this impact hammer, in which, if the design is not adequate, the impact hammer will stall and cannot be reloaded, until the hammer is removed from contact with the working face, and even then the poppet may dither and never seat to complete the loading of the tool.

The improvements shown in FIGS. 8-21 have overcome the above potential liabilities.

Upper face 166 of poppet 157 is importantly modified from that shown in FIGS. 1-7. It includes a primary closure edge 190 above a cylindrical metering surface 191 and a tapered surface 192 which extends upwardly to a cylindrical secondary metering surface 193.

The lower face 148 of the poppet port has been modified to work with the upper face 166 of the poppet. It includes an internal primary cylindrical metering surface 195 which makes a close, but not sealing fit, with metering surface 191. A tapered closure surface 196 extends upwardly to intersect a cylindrical secondary metering surface 197. The related dimensions are such that at its upward extreme, primary closure edge 190 seals against closure surface 196.

Surfaces 191 and 195 act together as a spool valve, as do surfaces 193 and 197.

Figure 18:
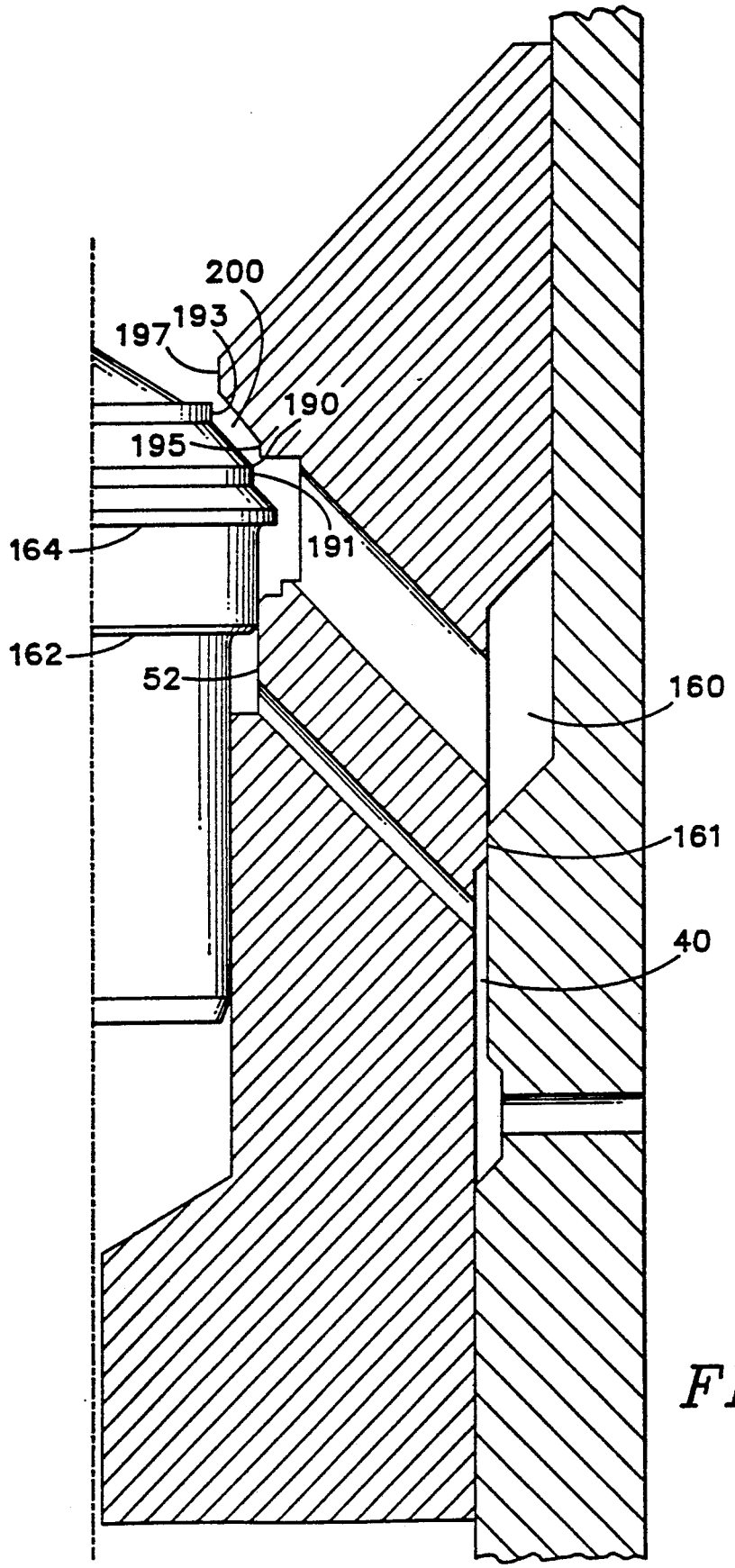

Importantly, the conical angle of tapered surface 192 on the poppet is greater by a few degrees, perhaps 2 degrees (smaller than can effectively be shown) than the conical angle of tapered closure surface 196, to create a small volume chamber 200 (FIG. 18). The axial length of chamber 200 is greater at its center than at its outer edge.

Secondary metering surface 193 on the poppet, and secondary metering surface 197 in the poppet port, make a close but not sealing fit, so as to exert a metering action.

Figure 16:
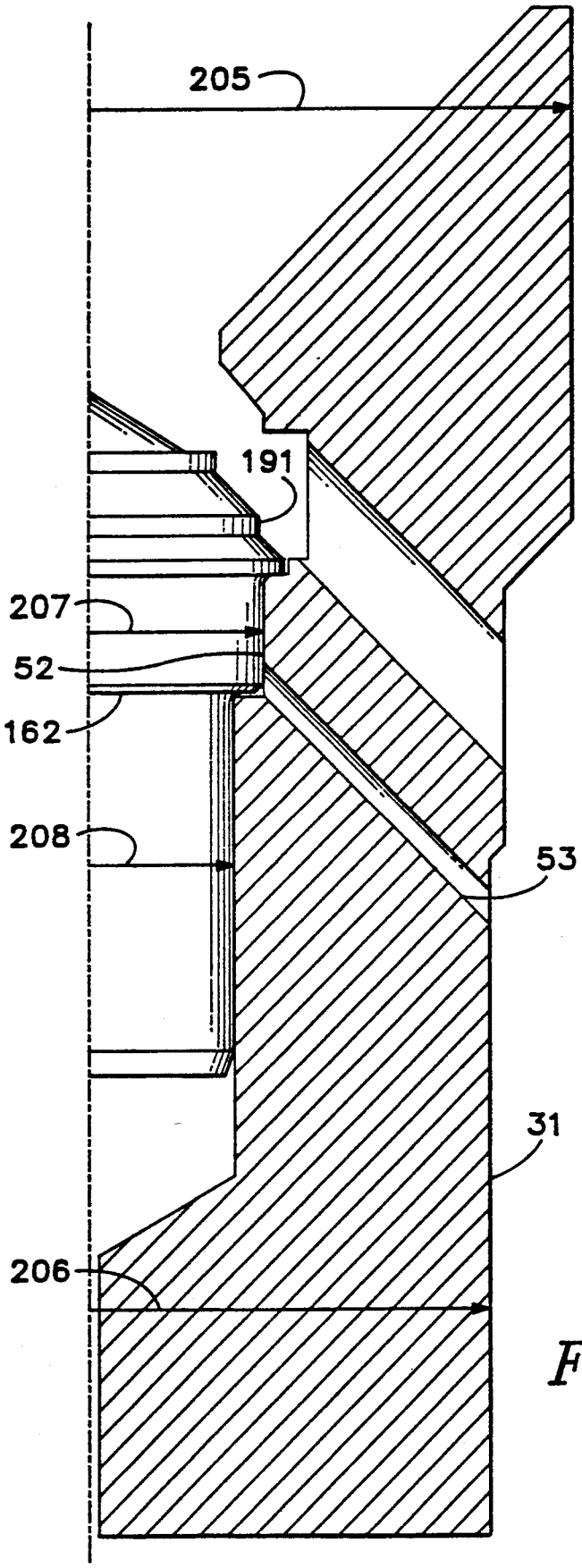
FIGS. 16-19 are further enlarged half axial cross-sections showing the construction and operation of the poppet in closer detail.
Figure 19:
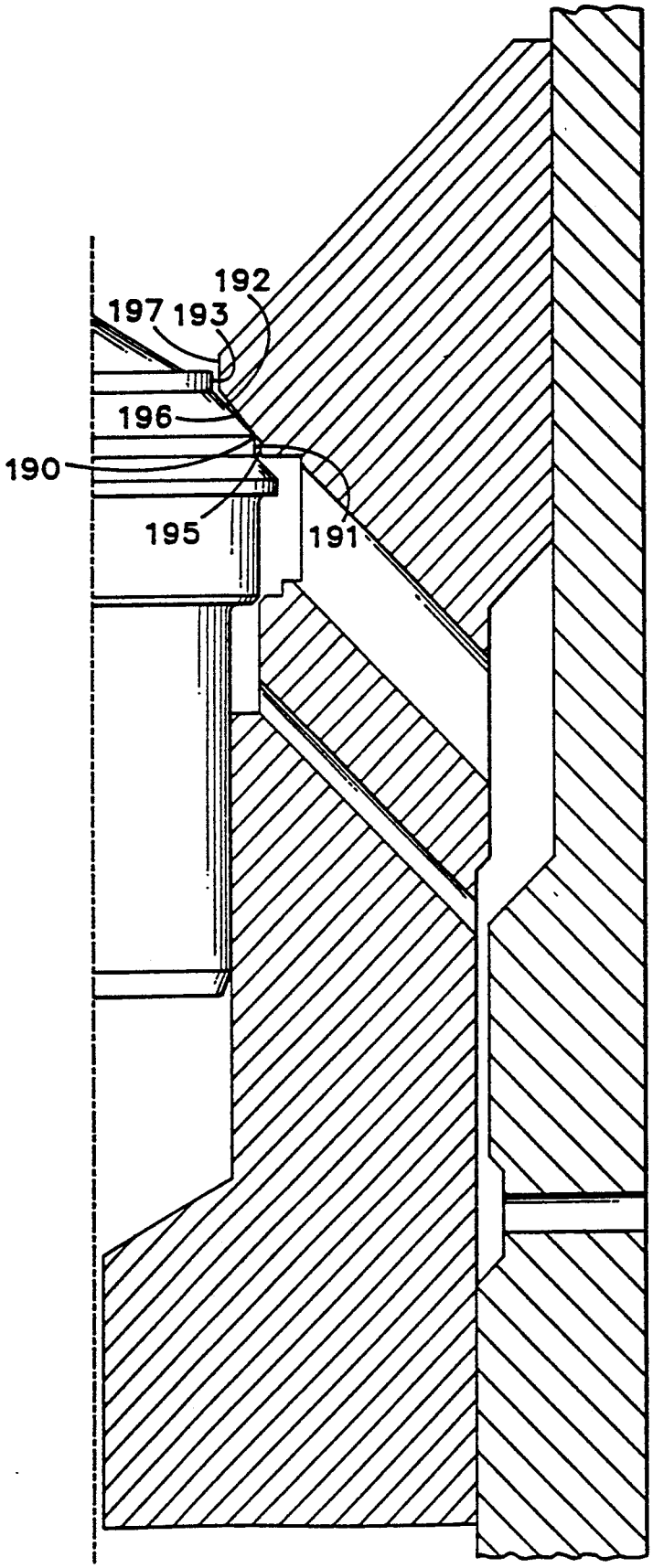

Some of the problems solved by this invention can best be understood in view of the circumstances shown in FIGS. 8, 16 and 19.

Assume in FIG. 8 a very common situation. The hammer has just completed its blow, and awaits reloading. Bear in mind that these are very heavy devices, supported on hydraulically powered booms which direct them and force them against a working face. Assume in FIG. 8 that the frame is being forced heavily downward against a working face. This will move the frame downwardly so that it rests against the shoulder on the impact tool. Now if enough axial force is exerted on the frame in addition to the weight of the frame, the tool cannot moved downwardly, and neither can the hammer head—the hammer head is simply restrained by the impact tool.

Offhand the inability of the hammer head to move downwardly would not appear to be a problem, but in the device of FIG. 1 it can be. This is because the poppet is open and the poppet chamber is open to compression chamber 47. The liquid above the poppet is in a "locked" condition, and the poppet could not start upwardly until the frame is lifted so the hammer head can move downwardly to make room in the poppet chamber for the poppet to enter the poppet chamber. This is a nuisance in operating the device and tends to lessen its productivity.

This circumstance is averted by proper selection of the amplification ratios of the poppet and of the hammer head. By amplification ration is meant the ratio between the areas active in driving a headed piston.

In this device, with reference to FIG. 16, the amplification ration (R head) of hammer head 31 is the total area (Ah) of the loaded collar, exemplified by its radius 205 divided by the area (Ah) of the head, less the area (As) of its shank, exemplified by the radius 206, thus: (Rhead)=Ah/Ah−As The amplification ratio of the poppet (R pop) is the area Ahp of the head of the poppet exemplified by radius of the poppet 207, divided by the area (Ahp less the area of (Asp) the poppet shank exemplified by radius 208 of the poppet shank, thus: (Rpop)=Ahp/Ahp−Asp According to this invention, (R head) must substantially exceed (R pop). For many practical installations, (R head) is approximately 4:1, and (R pop) is approximately 3.5:1.

It will be seen that a given pressure exerted at the inlet port 41 will develop a higher force differential tending to lift the poppet than the force differential tending to lift the hammer head. Thus, even though the hammer head is held down, the poppet can be forced up, compressing the gas cell in so doing. By appropriately dimensioning the above dimensions, the recited impasse is avoided, and the poppet can rise.

Figure 17:
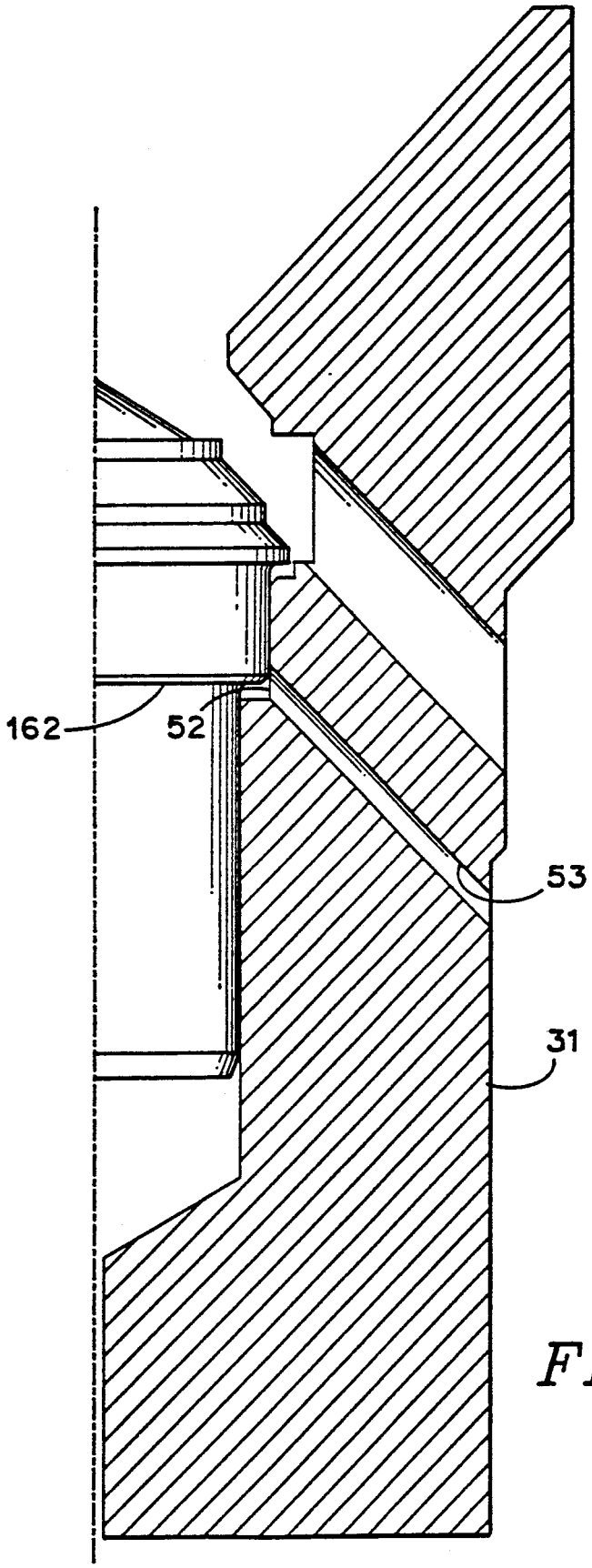

Now, however, the next problem arises. It is necessary to get the poppet closed and to keep it closed until the device is fired by contact of the trigger and the poppet. FIGS. 16–19 show the solution to this problem. In FIG. 16, closure of the poppet is about to begin, pressure to the underside of the poppet having entered through passages 53. An appropriately dimensioned poppet moves upwardly as shown in FIG. 17. The hammer head remains down.

In FIG. 18, the upper face of the poppet is approaching the lower face of the poppet port, and the wall of the poppet is nearing the upper end of poppet head chamber 52. The hammer head is still down. Notice, however, that cylindrical surfaces 191 and 193 are approaching their associated surfaces in the poppet head. Shortly they will act as sliding metering restrictions like a leaking spool valve, intended to pass liquid, but at a restricted rate. The hammer head is still down.

Also notice that restriction 161 has prevented flow from the inlet port into chamber 160.

FIG. 19 shows the poppet fully seated. Notice the clearance between surfaces 192 and 196. Now fluid under pressure is exerted in power chamber 160 moving the hammer head upwardly. As shown in FIG. 19, the restriction 161 between the loading chamber and the power chamber has disappeared and supply pressure is fully applied to the head, with the poppet closed. Full system pressure is now exerted on the poppet, and the same reduction ratio which assured its earlier action assures that it will not dither, but rather will stay closed.

Figure 20:
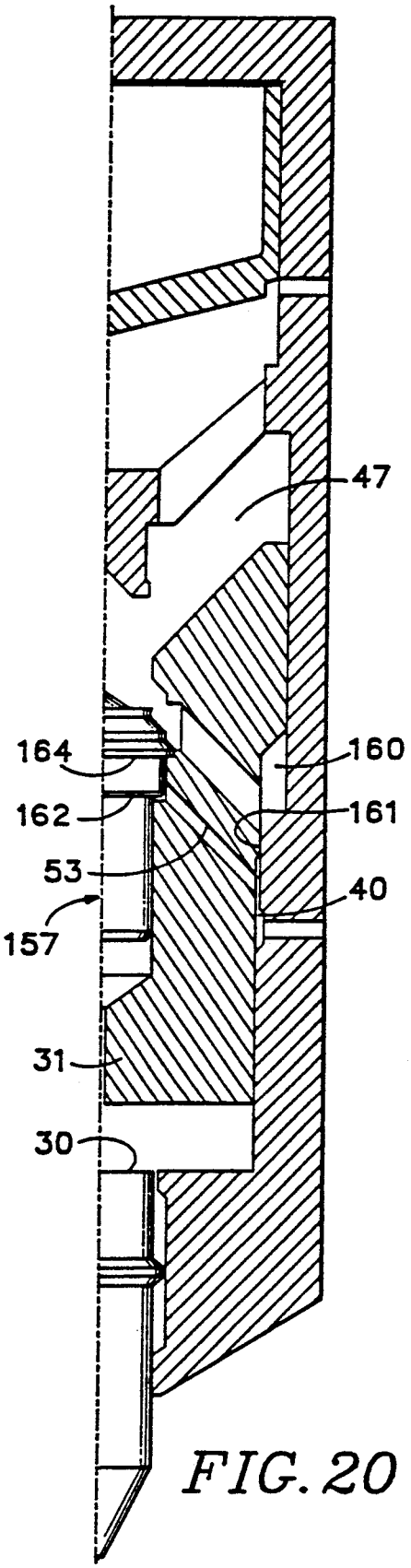
FIGS. 20 and 21 are enlarged half axial cross-sections showing the impact hammer in two conditions of hammer overtravel. DETAILED DESCRIPTION OF THE INVENTION This invention will best be understood from a general overview of its basic structure and function, after which the features of this invention which enable this structure to function reliably will be disclosed.
Figure 21:
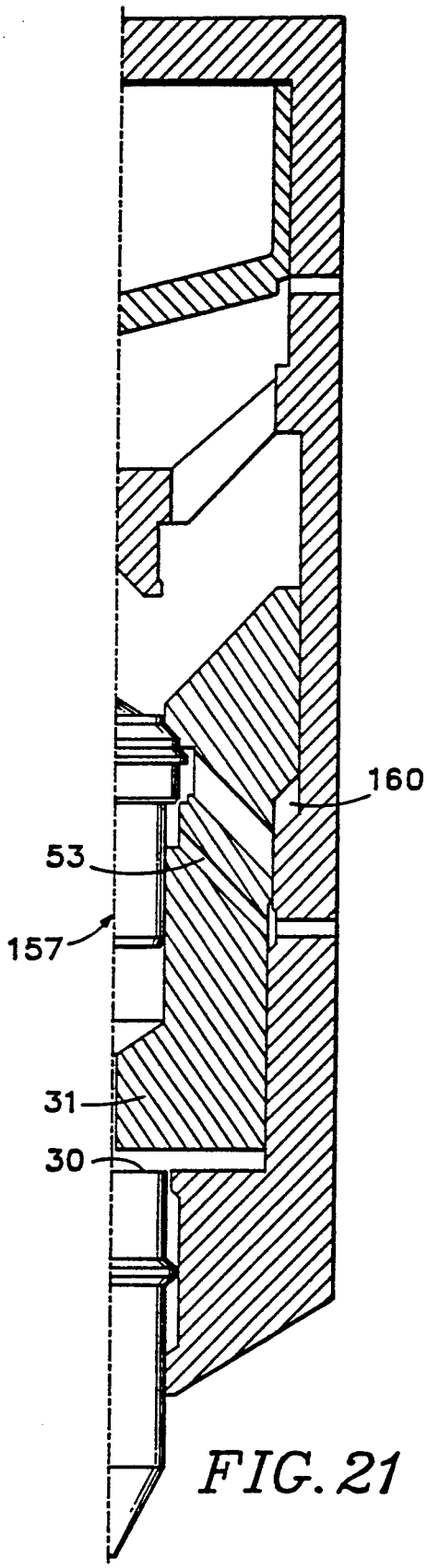

The protection of the hammer head and the frame from destructive damage on dry firing is best shown in FIGS. 20 and 21. In FIG. 20, the device has been fired and the hammer head is on its way. The poppet is open and is retracted. There is no resistance to the flight of the hammer head. However, restriction 161 has been created, and this isolates chambers 40 and 160 from one another. Fluid in chamber 160 can freely flow into chamber 47. However, fluid beneath the shoulder 162 of the poppet is trapped. Further movement of the hammer head reduces the volume of chamber 40, and attemps to raise the poppet to close as shown in FIG. 21. Reduction of the volume of chamber 160 now causes an appropriate braking of the hammer head. Overtravel is prevented in the sense that the hammer head is stopped before it strikes the frame.

With the above features, a fully reliable, versatile and long-lived impact hammer can be constructed.

This invention is not to be limited to the embodiments shown in the drawings and described in the description, which are given by way of example and not of limitation, but only in accordance with the scope of the appended claims.

I claim:

1. In an impact hammer of the type having a frame with an internal loading cylinder and a guide cylinder coaxial with each other, and a hammer head having a cylindrical collar slidably fitted matingly in said loading cylinder and a cylindrical shank slidably fitted matingly in said guide cylinder, the diameters of said loading cylinder and collar being greater than the diameters of said guide cylinder and shank so as to form a power chamber below said collar, a compression chamber within said frame exposed to said collar and a compressible gas cell facing into said compression chamber, a poppet chamber in said hammer head having a poppet port communicating with said compression chamber, a poppet having a cylindrical poppet head and a cylindrical poppet stem coaxial with each other, said hammer head having a cylindrical poppet head cylinder and a cylindrical poppet stem cylinder for matingly slidably receiving said poppet head and poppet stem, respectively, the diameters of said poppet head and poppet head cylinder being larger than the diameters of said poppet stem and poppet stem cylinder, said poppet head forming an annular poppet drive face between said poppet head and said poppet stem and said poppet head and poppet head cylinder forming a poppet head chamber below said poppet drive face, said poppet being movable selectively between respective positions closing or opening said poppet port, means to receive an impact tool for reciprocal movement in the frame so as to be struck by the hammer head, inlet means for admitting pressurized fluid both to said poppet head chamber and to said power chamber, and outlet means for discharging excess fluid, wherein the ratio of the cylindrical area of said collar of said hammer head to the differential between the cylindrical area of said collar and the cylindrical area of said shank of said hammer head defines the amplification ratio of said hammer head, and wherein the ratio of the cylindrical area of said poppet head to the differential between the cylindrical area of said poppet head and the cylindrical area of said poppet stem defines the amplification ratio of said poppet, the improvement wherein:

said amplification ratio of said hammer head is greater than said amplification ratio of said poppet so as to enable said poppet to close said poppet port under the influence of said pressurized fluid in said poppet head chamber in opposition to the pressure in said compression chamber, while said hammer head is simultaneously under the influence of said pressurized fluid in said power chamber but is unable to move in opposition to said pressure in said compression chamber.

2. In an impact hammer of the type having a frame with an internal loading cylinder and a guide cylinder coaxial with each other, and a hammer head having a cylindrical collar slidably fitted matingly in said loading cylinder and a cylindrical shank slidably fitted matingly in said guide cylinder, the diameters of said loading cylinder and collar being greater than the diameters of said guide cylinder and shank, a compression chamber within said frame exposed to said collar and a compressible gas cell facing into said compression chamber, a poppet chamber in said hammer head having a poppet port communicating with said compression chamber, a poppet having a cylindrical poppet head and a cylindrical poppet stem coaxial with each other, said hammer head having a cylindrical poppet head cylinder and a cylindrical poppet stem cylinder for matingly slidably receiving said poppet head and poppet stem, respectively, the diameters of said poppet head and poppet head cylinder being larger than the diameters of said poppet stem and poppet stem cylinder, said poppet head forming an annular poppet drive face between said poppet head and said poppet stem and said poppet head and poppet head cylinder forming a poppet head chamber below said poppet drive face, said poppet being movable selectively between respective positions closing or opening said poppet port, means to receive an impact tool for reciprocal movement in the frame so as to be struck by the hammer head, inlet means to admit fluid under pressure, and outlet means to discharge excess fluid, the improvement which comprises:

means for braking the movement of said hammer head, including a reduced cylindrical section on said shank of said hammer head forming a loading chamber between said reduced section and said guide cylinder, said reduced cylindrical section defining an annular step around said shank forming, in cooperation with said guide cylinder, a sliding fluid restriction between said loading chamber and said loading cylinder in some positions of the hammer head, and eliminating said restriction in other positions of the hammer head, said loading chamber communicating with said poppet head chamber beneath said poppet drive face for causing said poppet to substantially close said poppet port in response to the formation of said sliding fluid restriction as said hammer head moves toward said impact tool.

3. In an impact hammer of the type having a frame with an internal loading cylinder and a guide cylinder coaxial with each other, and a hammer head having a cylindrical collar slidably fitted matingly in said loading cylinder and a cylindrical shank slidably fitted matingly in said guide cylinder, the diameters of said loading cylinder and collar being greater than the diameters of said guide cylinder and shank, a compression chamber within said frame exposed to said collar and a compressible gas cell facing into said compression chamber, a poppet chamber in said hammer head having a poppet port communicating with said compression chamber, a poppet having a cylindrical poppet head and a cylindrical poppet stem coaxial with each other, said hammer head having a cylindrical poppet head cylinder and a cylindrical poppet stem cylinder for matingly slidably receiving said poppet head and poppet stem, respectively, the diameters of said poppet head and poppet head cylinder being larger than the diameters of said poppet stem and poppet stem cylinder, said poppet head forming an annular poppet drive face between said poppet head and said poppet stem and said poppet head and poppet head cylinder forming a poppet head chamber below said poppet drive face, said poppet being movable selectively between respective positions closing or opening said poppet port, means to receive an impact tool for reciprocal movement in the frame so as to be struck by the hammer head, inlet means to admit fluid under pressure, and outlet means to discharge excess fluid, the improvement which comprises:

respective frusto-conical surfaces on said poppet head and on said poppet port, one of said frusto-conical surfaces having a different conical angle than the other so as to form an annular chamber therebetween of greater axial length nearer to the axis of said poppet than farther from said axis for enclosing fluid in a confined space as said poppet closes said poppet port, one of said frusto-conical surfaces having edge means at its extremity furthest from said axis for closing said poppet port by abutting the other frusto-conical surface.

4. In an impact hammer of the type having a frame and a hammer head slidably mounted within said frame so as to move along a predetermined axis, said hammer head having respective first and second pressure surfaces, of different effective areas for exposure to fluid pressure, located on opposite sides of said hammer head transverse to said axis, a chamber within said hammer head communicating with a poppet port formed in said first pressure surface of said hammer head, a poppet slidably mounted within said chamber so as to move along said axis between respective positions closing or opening said poppet port, said poppet port enabling communication between said second pressure surface and said first pressure surface of said hammer head when said poppet port is open and preventing said communication when said poppet port is closed, respective further first and second pressure surfaces, of different effective areas for exposure to fluid pressure, located on opposite sides of said poppet transverse to said axis, a compression chamber within said frame exposed to the first pressure surface of said hammer head and the first pressure surface of said poppet, respectively, inlet means for admitting pressurized fluid to the second pressure surface of said hammer head and the second pressure surface of said poppet, respectively, outlet means for discharging excess fluid, and means for receiving an impact tool for reciprocal movement in the frame so as to be struck by said hammer head, the improvement wherein:

the ratio of the effective area of the first pressure surface of said hammer head to the effective area of the second pressure surface of said hammer head is greater than the ratio of the effective area of the first pressure surface of said poppet to the effective area of the second pressure surface of said poppet, so as to enable said poppet to close said poppet port when the second pressure surface of said poppet is exposed to said pressurized fluid in opposition to the pressure in said compression chamber while the second pressure surface of said hammer head is simultaneously exposed to said pressurized fluid but is unable to move in opposition to said pressure in said compression chamber.

5. In an impact hammer of the type having a frame and a hammer head slidably mounted within said frame so as to move along a predetermined axis, said hammer head having respective first and second pressure surfaces located on opposite sides thereof transverse to said axis, a chamber within said hammer head communicating with a poppet port formed in said first pressure surface of said hammer head, a poppet slidably mounted within said chamber so as to move along said axis between respective positions closing or opening said poppet port, said poppet port enabling communication between said second pressure surface and said first pressure surface of said hammer head when said poppet port is open and preventing said communication when said poppet port is closed, respective further first and second pressure surfaces located on opposite sides of said poppet transverse to said axis, a compression chamber within said frame exposed to the first pressure surface of said hammer head and the first pressure surface of said poppet, respectively, inlet means for admitting pressurized fluid to the second pressure surface of said hammer head and the second pressure surface of said poppet, respectively, outlet means for discharging excess fluid, and means for receiving an impact tool for reciprocal movement in the frame so as to be struck by said hammer head, the improvement comprising:

means for braking the movement of said hammer head comprising means responsive to the slidable position of the hammer head within said frame for selectively enclosing fluid in a confined space in response to said hammer head reaching a predetermined position while moving toward said impact tool, said confined space communicating with the second pressure surface of said poppet for exerting pressure thereon and thereby causing said poppet to substantially close said poppet port in response to said hammer head reaching said predetermined position.

* * * * *

UNITED STATES PATENT AND TRADEMARK OFFICE

CERTIFICATE OF CORRECTION

PATENT NO. : 5,065,824

DATED : November 19, 1991

INVENTOR(S) : Jack B. Ottestad

It is certified that error appears in the above-identified patent and that said Letters Patent is hereby corrected as shown below:

Col. 4, line 41, Change "At" to --A--.

Col. 9, line 45 Change "ration" to --ratio--.

Col. 9, line 54 Change "Ahp" to --(Ahp)--.

Signed and Sealed this

Fifteenth Day of June, 1993

*Attest:*

Michael K. Kirk

MICHAEL K. KIRK

*Attesting Officer*

*Acting Commissioner of Patents and Trademarks*